US008059828B2

(12) United States Patent
Ho et al.

(10) Patent No.: US 8,059,828 B2
(45) Date of Patent: Nov. 15, 2011

(54) AUDIO PRIVACY METHOD AND SYSTEM

(75) Inventors: Chi Fai Ho, Palo Alto, CA (US); Shin Cheung Simon Chiu, Palo Alto, CA (US)

(73) Assignee: TP Lab Inc., Palo Alto, CA (US)

( * ) Notice: Subject to any disclaimer, the term of this patent is extended or adjusted under 35 U.S.C. 154(b) by 1049 days.

(21) Appl. No.: 11/302,913

(22) Filed: Dec. 14, 2005

(65) Prior Publication Data

US 2007/0135176 A1 Jun. 14, 2007

(51) Int. Cl.
*H04R 3/02* (2006.01)

(52) U.S. Cl. ..... 381/73.1; 381/71.1; 381/110

(58) Field of Classification Search ..... 381/71.1–71.14, 381/104, 106, 107, 110, 73.1
See application file for complete search history.

(56) References Cited

U.S. PATENT DOCUMENTS

| | | | | |
|---|---|---|---|---|
| 4,266,094 | A * | 5/1981 | Abend | 381/98 |
| 5,251,263 | A * | 10/1993 | Andrea et al. | 381/71.6 |
| 5,289,544 | A * | 2/1994 | Franklin | 381/313 |
| 5,319,715 | A * | 6/1994 | Nagami et al. | 381/71.14 |
| 5,495,527 | A * | 2/1996 | Rollhaus et al. | 379/388.03 |
| 6,639,987 | B2 * | 10/2003 | McIntosh | 381/71.6 |
| 6,690,800 | B2 * | 2/2004 | Resnick | 381/73.1 |
| 6,741,707 | B2 * | 5/2004 | Ray et al. | 381/71.11 |
| 6,754,353 | B1 * | 6/2004 | Cheng | 381/71.1 |
| 6,996,241 | B2 * | 2/2006 | Ray et al. | 381/71.11 |
| 7,013,011 | B1 * | 3/2006 | Weeks et al. | 381/98 |
| 7,088,828 | B1 * | 8/2006 | Bradford et al. | 381/71.1 |
| 2001/0046303 | A1 * | 11/2001 | Ohnishi et al. | 381/71.7 |
| 2004/0125922 | A1 * | 7/2004 | Specht | 379/88.01 |
| 2005/0065778 | A1 * | 3/2005 | Mastrianni et al. | 704/200.1 |
| 2007/0086603 | A1 * | 4/2007 | Lyon et al. | 381/96 |

* cited by examiner

*Primary Examiner* — Xu Mei
(74) *Attorney, Agent, or Firm* — Timothy X. Gibson, Esq.; Gibson & Dernier, LLP

(57) ABSTRACT

Provided is a method and system for audio privacy that includes receiving a first sound signal at a microphone proximal to a user's ear, generating a second sound signal based on the first sound signal and a stored filter, the second sound signal interfering with the first sound signal, and emitting the second sound signal from a speaker proximal to the user's ear.

16 Claims, 4 Drawing Sheets

AUDIO PRIVACY METHOD AND SYSTEM

BACKGROUND OF THE INVENTION

During a telephone call, a telephone user uses a telephone to communicate with other users, oftentimes in an open or noisy environment, such as inside a cubicle, a kitchen, a coffee house, a conference room, a shopping mall, an airport, a library or a lobby. A telephone call may be a two-party or a multiple-party call.

A telephone call may be used for personal communication, such as two friends engaging in a conversation, a daughter talking to her grandpa, a nephew asking his aunt for a secret recipe, a newly wedded couple inviting their parents for a Thanksgiving gathering, a customer enquiring a business for business hours and direction, a guest making a dinner reservation with a restaurant, or a subscriber making an request with a cable company for the repair of her cable connection.

For personal communication, depending on the information being exchanged during the call, it may be desirable to protect the privacy of the telephone users so that the information exchanged is not intelligible to unintended audience.

A telephone call may also be used for business or in business-to-business communication, such as a contractor talking to a city manager about a bid for a project, a client ordering goods from a supplier, an insurance adjustor taking damage assessment from a hurricane stricken home owner, a nurse discussing a medical condition with a patient, a stock broker giving financial advice to a client, a lawyer speaking to a client on sensitive legal strategy, a product distributor asking an equipment vendor for technical information, a health clinic nurse delivering a appointment confirmation to a patient, or a credit card company representative alerting a customer of unusual activity on a credit card account.

A telephone call may also be used for collaboration within a business, such as a traveling salesman asking for updated pricing information from her peer, a customer service manager requesting product integration information from a project manager, two engineers discussing an application programming interface, a emergency room nurse seeking critical advice from a doctor, or several executives engaging in a conference call on company financial matters.

For business communication, the information being exchanged may be critical to the operation of the business or businesses involved. It therefore may be essential to protect the privacy of the telephone users so that the information exchanged is not intelligible to unintended audience.

The importance of protecting the privacy for business communication becomes increasingly important with the escalating cost of travel, the proliferation of service outsourcing, and international business partnership as a result of globalization.

The above examples demonstrate a need to provide audio privacy for a user during a telephone call.

SUMMARY OF THE INVENTION

An aspect of the present invention provides an audio privacy method. The method includes receiving a first sound signal at a microphone proximal to a user's ear, generating a second sound signal to substantially destructively interfere with the first sound signal, and emitting the second sound signal from a speaker proximal to the user's ear.

In one aspect of the invention, the first sound signal described above includes ambient noise.

In another aspect of the invention, the microphone and speaker are associated with a telephone.

In another aspect of the invention, the method further includes a third sound signal emitting proximal to the user's ear, the interfering of the first and second sound signals improving the intelligibility of the third sound signal. In an embodiment, the third sound signal comprises a human voice.

Another aspect of the present invention provides a personal conversation device. The personal conversation device includes a signal sampling module for receiving a first audio signal, a signal interfering module for emitting a second sound signal, and a signal processing module, operatively connected to receive the first audio signal from the signal sampling module and to generate a second sound signal to the signal interfering module. The second sound signal is generated to substantially destructively interfere with the first sound signal.

In an aspect of the invention, the personal conversation device comprises a jewelry item.

In an aspect of the invention, the personal conversation device comprises a headset.

In an aspect of the invention, the personal conversation device comprises an eyeglass.

In another aspect of the invention, the signal processing module of the personal conversation device includes an application specific integrated circuit ("ASIC").

An aspect of the present invention provides a virtual sound wall device. The virtual sound wall device includes a signal sampling module, a signal interfering module, and a signal processing module. The signal processing module is operatively connected to the signal sampling module and signal interfering module. The signal processing module is configured to generate a signal for the signal interfering module that interferes with a signal received from the signal sampling module. In an embodiment, the signal sampling and signal interfering modules are located along a boundary separating a noisy area from a quiet space.

In an aspect of the invention, the signal processing module includes a microprocessor and associated memory, and the microprocessor is configured to perform the signal generating function of the signal processing module.

In an aspect of the invention, the signal sampling module is configured to filter out sounds over a predetermined decibel level. In an embodiment, the predetermined decibel level is 100 decibels.

DETAILED DESCRIPTION

Figure 1:
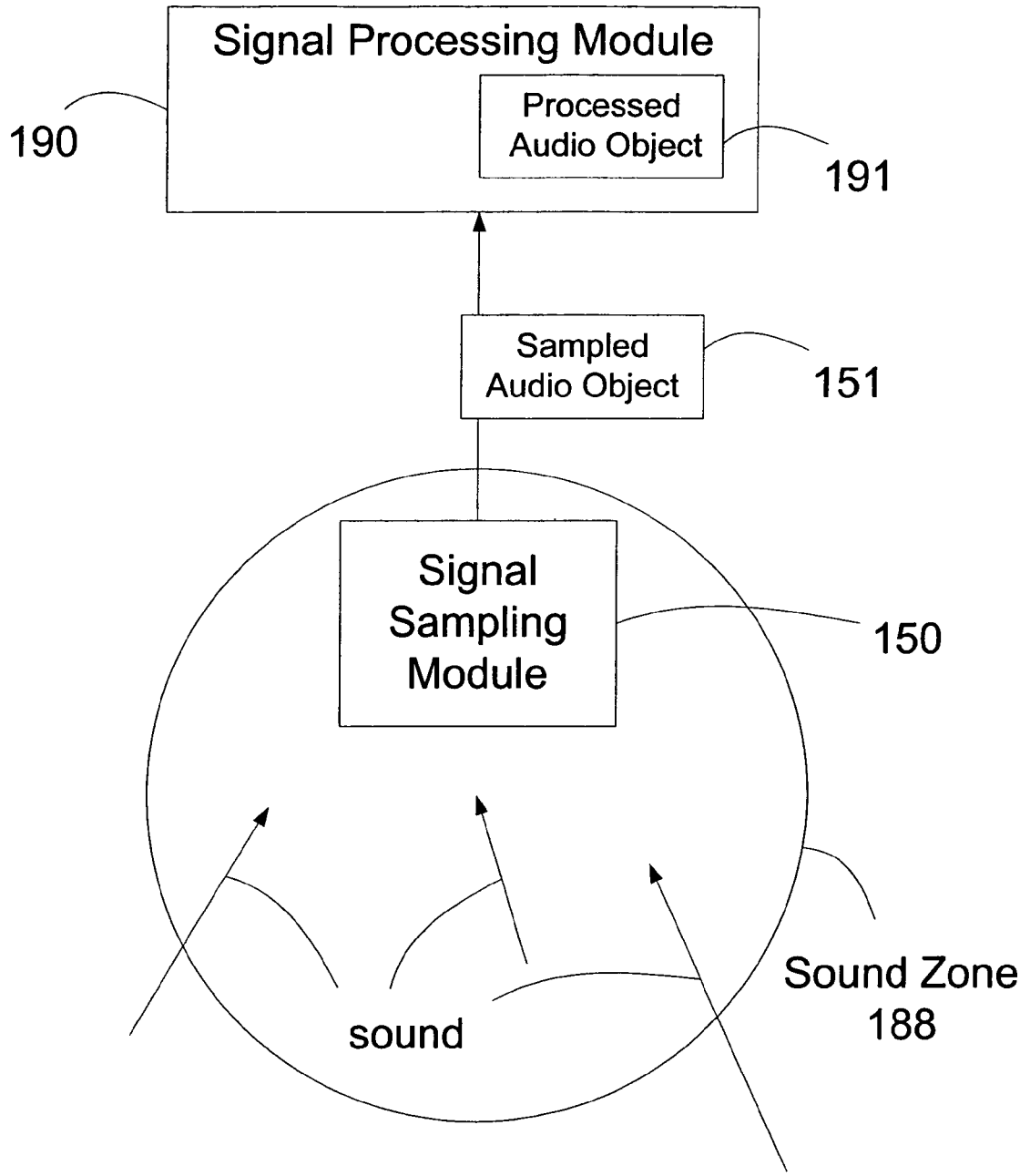
FIG. 1 is a schematic diagram illustrating an exemplary system of sampling and processing a sound.

In the following description, for purposes of explanation, specific numbers, materials and configurations are set forth in order to provide a thorough understanding of the invention. It will be apparent, however, to one having ordinary skill in the art, that the invention may be practiced without these specific details. In some instances, well-known features may be omitted or simplified so as not to obscure the present invention. Furthermore, reference in the specification to "one embodiment" or "an embodiment" means that a particular feature, structure or characteristic described in connection with the embodiment is included in at least one embodiment of the invention. The appearances of the phrase "in an embodiment" in various places in the specification are not necessarily all referring to the same embodiment.

Sounds are generally longitudinal pressure waves (hereinafter, "sound waves") emitted by a sound source, which travel in a suitable conducting medium, such as air. Multiple sounds waves interfere with one another to form a combined sound. Where a high pressure peak in one sound wave interferes with a high pressure peak in another sound wave, the two sound waves combine to produce a sound wave having a high pressure peak that is higher than the high pressure peaks of either sound wave before their combination. This is also known as "constructive" interference, and the two original sound waves are said to have constructively interfered with each other.

Alternatively, where a high pressure peak in one sound wave interferes with a low pressure trough in another sound wave, the two sound waves combine to produce a sound wave having a high pressure peak that lower than the original high pressure peak of the first sound wave before their combination. This is also known as "destructive" interference, and the two original sound waves are said to have destructively interfered with each other. When the high pressure peaks of one sound wave perfectly aligns with the low pressure trough in another sound wave having an identical amplitude and frequency, the two sound waves destructively interfere to cancel each other out, resulting in a lack of sound. Inverting a sound wave and then having the inverted sound wave interfere with the original sound wave will also cause such destructive interference. In the application, it is understood that destructive interference may be referred to as interference of a wave with an inverted copy of the wave, and that a sound wave may be "substantially" eliminated by interference with an inverted copy of the sound wave, and such destructive interference may be desirable even if it does not result in absolutely complete elimination.

An audio object as herein used is a representation or an approximation of a sound. In an embodiment, an audio object is a sample of sound. In another embodiment, an audio object is used to generate a sound. In an embodiment, an audio object uses a digital format to represent a sound. In another embodiment, an audio object uses an analog format to represent a sound. In some embodiments of the invention, an audio object may be transformed between digital and analog formats.

In an embodiment of the invention, a sound sampling device generates an audio object by sampling a sound for a sampling time interval. For example, in an embodiment, the sampling time interval is $1/8{,}000$ of a second based on an 8,000 per second, or 8 kHz sampling rate; the audio object represents or approximates the sound for $1/8{,}000$ of a second. In another embodiment, the sampling time interval is $1/44{,}100$ of a second based on a 44,100 per second, or 44.1 kHz sampling rate. In another embodiment, the sampling time interval is $1/96{,}000$ of a second based on a 96,000 per second, or 96 kHz sampling rate.

In an embodiment, a signal processing device generates an audio object. For example, the signal processing device generates an audio object by synthesizing the audio object. In another embodiment, the signal processing device generates the audio object based on a sampled audio object. In another embodiment, the signal processing device generates the audio object based on a synthesized audio object. In another embodiment, the signal processing device generates the audio object based on an audio factor, such as an amplitude normalization factor.

In an embodiment, an audio object is converted to an electrical signal. For example, a speaker uses an electrical signal to generate a sound. In another embodiment, an audio object uses a-law Pulse Code Modulation ("PCM") format to encode a sound. In another embodiment, an audio object uses μ-law Pulse Code Modulation ("PCM") format to encode a sound. In another embodiment, an audio object uses an MP3 (MPEG1, Audio Layer 3) format to encode a sound. In another embodiment, an audio object uses a Linear Pulse Code Modulation ("LPCM") format to encode a sound. Other formats may also be used to encode a sound.

FIG. 1 schematically illustrates a system of sampling and processing a sound. In an embodiment, sound zone 188 is a space where multiple sounds interfere with one another to form a combined sound.

In an embodiment, a signal sampling module 150 is inside a sound zone 188, and includes the functionality of sampling the combined sound to generate a sampled audio object 151. Sampled audio object 151 is an audio object. In an embodiment, signal sampling module 150 sends the sampled audio object 151 to a signal processing module 190, which includes the functionality of generating a processed audio object 191. In such an embodiment, signal processing module 190 receives sampled audio object 151 and generates a processed audio object 191, which is also an audio object. In one embodiment, signal processing module 190 generates a processed audio object 191 based on the sampled audio object 151.

In an embodiment, signal sampling module 150 may generate a plurality of sampled audio objects 151 by sampling the combined sound over a plurality of sampling time intervals. Likewise, in an embodiment, signal processing module 190 may receive a plurality of sampled audio objects 151 from the signal sampling module 150, and generate a plurality of process audio objects 191.

Figure 2:
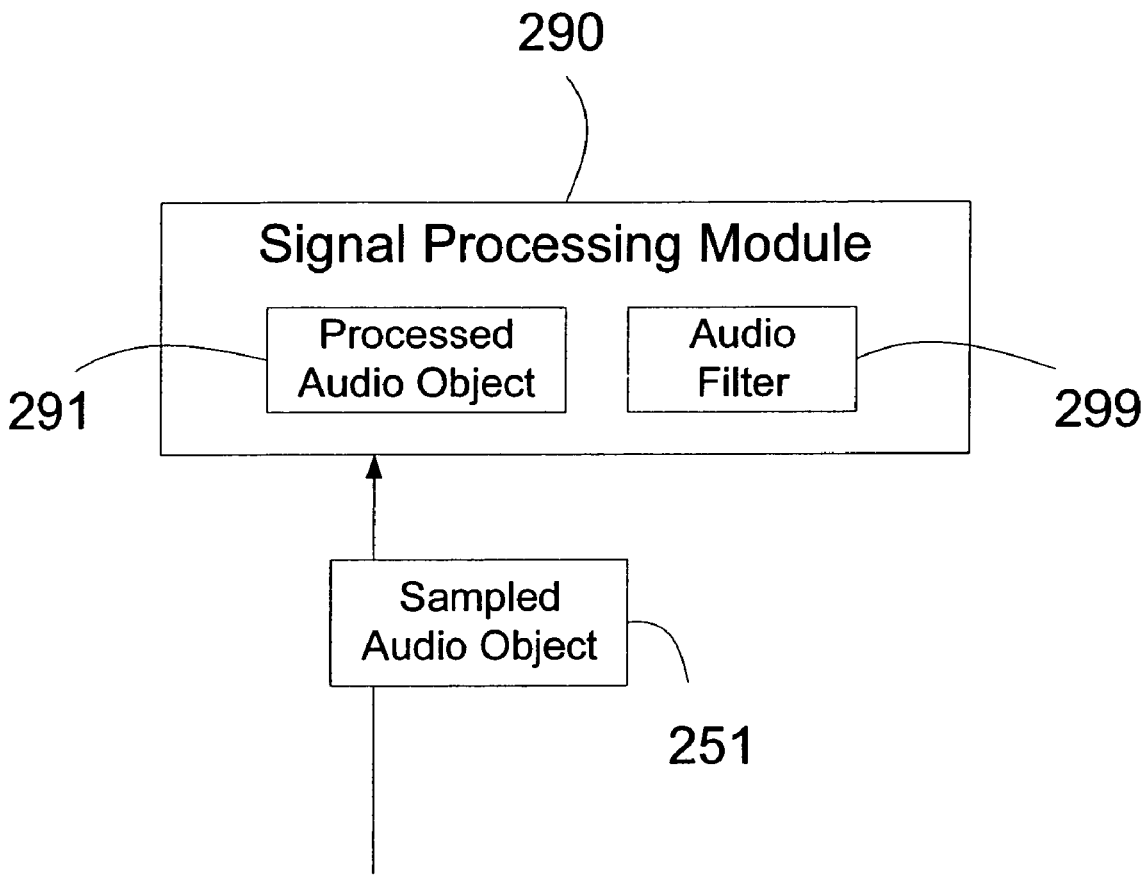
FIG. 2 is a schematic diagram of an exemplary process for the signal processing module to generate a processed audio object.

An exemplary process for the signal processing module to generate a processed audio object is schematically illustrated in FIG. 2. In an embodiment, signal processing module 290 receives a sampled audio object 251 and generates a processed audio object 291 based on the sample audio object 251. In one embodiment, signal processing module 290 includes one or more audio filters 299. Signal processing module 290 generates a processed audio object 291 using the sampled audio object 251 and one or more of audio filters 299 in an embodiment.

In an exemplary embodiment, signal processing module 290 computes a first audio object as the result of subtracting the sound represented by audio filter 299 from the sound represented by sampled audio object 251. Signal processing module 290 computes a second audio object as the result of inverting the first audio object. In one embodiment, the first audio object uses an analog format and the signal processing module 290 performs an analog signal inversion of the first audio object. In another embodiment, the first audio object uses a-law PCM format and the signal processing module 290 changes the sign bit of the first audio object to form a second audio object (not depicted). In such an embodiment, the signal process module 290 generates a processed audio object 291 using the second audio object.

In an embodiment, an audio filter 299 includes an audio normalization factor and signal processing module 290 generates a processed audio object 291 that represents a sound as the result of adjusting, based on audio filter 299, the amplitude of the sound represented by an audio object, such as sampled audio object 251.

Also in an embodiment, an audio filter 299 includes a frequency range. In one embodiment, signal processing module 290 generates a processed audio object 291 that represents the sound resulting form removing, based on audio filter 299, the sound inside the frequency range from an audio object, such as sampled audio object 251. For example, in an embodiment, audio filter 299 may remove from an audio object any sound within the frequency range of a human voice.

In another embodiment, signal processing module 290 generates a processed audio object 291 that represents a sound as the result of removing, based on audio filter 299, the sound outside the frequency range from an audio object, such as the sampled audio object 251.

Figure 3:
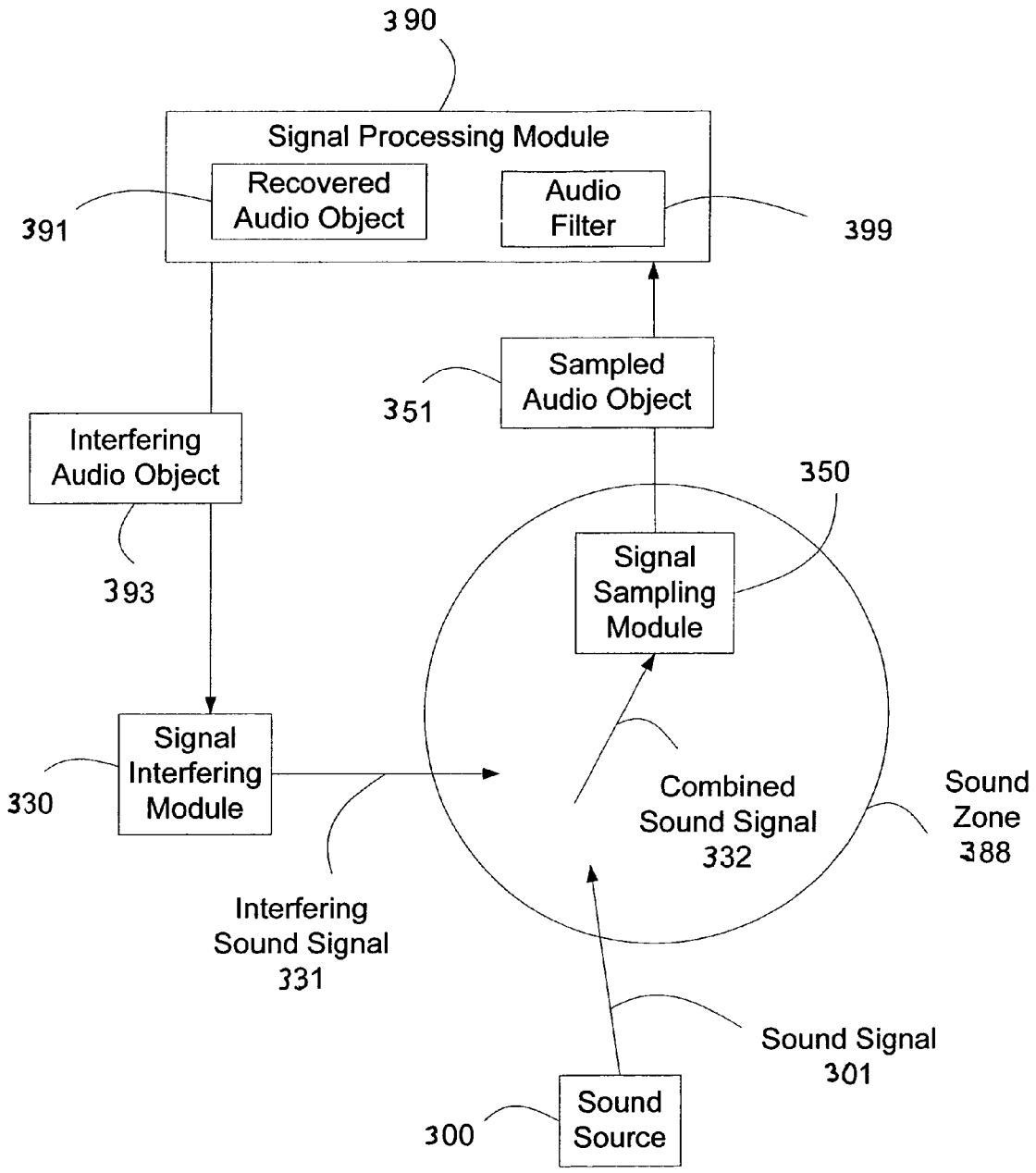
FIG. 3 is a schematic diagram illustrating a system for providing a quiet space in an embodiment of the present invention.

FIG. 3 illustrates a system for providing a quiet space in an embodiment of the present invention. An exemplary system for providing a quite space includes a signal sampling module 350, a signal processing module 390, and a signal interfering module 330. In an embodiment, signal interfering module 330 includes the functionality of emitting a sound.

In an embodiment, a sound source 300 emits a sound signal 301. For example, sound source 300 may be a speaking person, a playing audio recorder, a playing musical instrument, an operating vacuum, a dish washer, a cloth washer, a cloth dryer, or a television. It may also be a passing vehicle, a roaring train, or a soaring airplane. In an embodiment, sound source 300 may be a choir, a band, or an orchestra, or a busy freeway, a buzzing shopping mall, or a noisy restaurant.

In an embodiment, signal interfering module 330 emits an interfering sound signal 331. The interfering sound signal 331 and the sound signals 301 emitted by the multiple sound sources 300 combine to form a combined sound signal 332 inside a sound zone 388. In an embodiment, this combined sound signal 332 may be heard by a person inside sound zone 388, or recorded by a voice recorder inside sound zone 388. In another embodiment, a microphone inside the sound zone 388 captures the combined sound signal 332.

In a further embodiment, signal sampling module 350 may be inside sound zone 388. Signal sampling module 350 samples the combined sound signal 332 over a series of sampling time intervals to generate a sequence of sampled audio objects 351. Each sampled audio object 351 represents the combined sound signal 332 for a sampling time interval for the sampled audio object 351. Preferably, the signal sampling module 350 sends the sequence of sampled audio objects 351 to the signal processing module 390.

In an embodiment, the signal processing module 390 generates a sequence of interfering audio objects 393 based on the sequence of sampled audio objects 351 it receives. An embodiment of the signal processing module 390 includes an audio filter 399, which is an audio object approximating the interfering sound signal 331 emitted by the interfering sound module 330.

Also in an embodiment, for each sampled audio object 351, the signal processing module 390 computes a recovered audio object 391 by subtracting the sound represented by the audio filter 399 from the sound represented by the sampled audio object 351. In one embodiment, audio filter 399 and sampled audio object 351 use an analog format, and the signal processing module 390 performs an analog signal subtraction of audio filter 399 from sampled audio object 351. In such an embodiment, the audio filter 399 and the sampled audio object 351 use a logarithmic PCM format, such as a-law PCM format or μ-law PCM format. Signal processing module 390 converts the audio filter 399 to a first numeric amplitude level and the sampled audio object 351 to a second numeric amplitude level, performs a numeric subtraction of the first numeric amplitude level from the second numeric amplitude level, and converts the result of the subtraction to the logarithmic PCM format.

In an embodiment, the recovered audio object 391 represents an approximation of the combined sound signal of the multiple sound signals 301. For example, the signal processing module 390 generates an interfering audio object 393 that represents a sound as the inverted version of the sound represented by the recovered audio object 391. In one embodiment, the recovered audio object 391 uses an analog format, and the signal processing module 390 performs an analog signal inversion of the recovered audio object 391 to generate an interfering audio object 393. In another embodiment, the recovered audio object uses a-law PCM format and the signal processing module 390 changes the sign bit of the recovered audio object 391 to generate an interfering audio object 393.

In an embodiment, the signal processing module 390 replaces the audio filter 399 with the interfering audio object 393. In such an embodiment, the new audio filter 399 is used in the processing of the next sampled audio object 351.

Equation 1, 2, and 3 illustrate the above process of generating interfering audio object 393 in an exemplary embodiment.

$$RAO=\text{Subtract}(SAO, AF) \quad \text{Equation 1}$$

$$IAO=\text{Invert}(RAO) \quad \text{Equation 2}$$

$$AF=IAO \quad \text{Equation 3}$$

In these equations, RAO denotes recovered audio object 391, IAO denotes interfering audio object 393, SAO denotes sampled audio object 351, and AF denotes audio filter 399, and Subtract( ) is the subtracting function, and Invert( ) is the inversion function. Also, the signal processing module 390 repeats the process for each of the sequence of sampled audio objects 351 to generate a sequence of interfering audio objects 393.

In one embodiment, for the processing of the first sampled audio object 351, the audio filter 399 has a value of zero. In another embodiment, the audio filter 399 has a random value.

In an embodiment, the generation of an exemplary sequence of interfering audio objects 393 is illustrated as follows. The sequence of sampled audio objects 351 generated by the signal sampling module 350 is denoted as SAO(1), SAO(2), SAO(3), . . . , SAO(n−1), SAO(n), SAO(n+1), SAO (n+2), . . . , where n denotes the order in which signal sampling module 350 generates the sequence of sampled audio objects 351. The signal processing module 390 receives the sequence of the sampled audio objects 351 in the same order. Equations 4, 5, and 6 illustrate this as follows:

$$RAO(n)=\text{Subtract}(SAO(n), AF(n-1)) \quad \text{Equation 4}$$

$$IAO(n)=\text{Invert}(RAO(n)) \quad \text{Equation 5}$$

$$AF(n)=IAO(n) \quad \text{Equation 6}$$

In these equations, RAO(n) is the recovered audio object 393 generated by the signal processing module 390 based on SAO(n), AF(n−1) is the audio filter 399 at the time when the signal processing module 391 processes SAO(n), IAO(n) is the interfering audio object 393 generated by the signal processing module 390 based on RAO(n), and AF(n) is the audio filter 399 after the signal processing module 390 replaces the audio filter 399 with IAO(n). The initial value of the audio filter 399 is denoted by AF(0). In one embodiment, AF(0) has a value of 0. In another embodiment, the initial AF(0) has a random value.

In an embodiment, the signal processing module 390 sends the sequence of interfering audio objects 393 denoted as IAO(1), IAO(2), IAO(3), . . . , IAO(n−1), IAO(n), IAO(n+1) to the signal interfering module 330, which then converts IAO (1), IAO(2), IAO(3), . . . , IAO(n−1), IAO(n), IAO(n+1) into the interfering sound signal 331, which in turn, is then emitted by the signal interfering module 330.

In one embodiment, the interfering sound signal 331 equals or approximates the plurality of sound signals 301, and the combined sound signal 332 does not allow the plurality of sound signals 301 to be heard intelligibly due to the cancellation or weakening effect of the interfering sound signal 331. For example, at a first sampling time interval, the generated SAO(n) represents the combined sound of a first sample of the plurality of sound signals 301 and a first sample of the interfering sound signal 331 emitted based on the preceding IAO (n−1). According to Equation 6, the Audio Filter AF(n−1) is IAO(n−1). Subtract (SAO(n), AF(n−1)) as in Equation 4 is the same as Subtract (SAO(n), IAO(n−1)). The resulting ROA(n) is an approximation of the first sample of the multiple sound signals 301. IAO(n), being Invert(RAO(n)) according to Equation 5, is the inverted version of the approximation of the first sample of the plurality of sound signals 301.

Continuing with the example, at a second sampling time interval, the emitted interfering sound signal 331 based on IAO(n) interferes with a second sample of the sound signals 301. In one embodiment, the second sample of the sound signals 301 is similar to the first sample of the sound signals 301, and the interfering sound signal 331 based on IAO(n) cancels or weakens the second sample of the sound signals 301.

In an embodiment, the audio filter 399 includes an audio normalization factor, and the subtract function includes adjusting the amplitude of the recovered audio object 391 to an amplitude level indicated by the audio normalization factor. In one embodiment, the subtract function includes adjusting the amplitude of the recovered audio object 391 to the amplitude level when the amplitude of the sound represented by recovered audio object 391 exceeds a threshold.

In one embodiment, the audio filter 399 includes a frequency range of human voice. In an embodiment, the frequency range is 200 Hz to 3500 Hz. In another embodiment, the frequency range is 120 Hz to 3800 Hz. In one embodiment, the subtract function removes from sampled audio object 351 the sound inside the frequency range of human voice as indicated by audio filter 399. In another embodiment, the subtract function removes from the sampled audio object 351 the sound outside the frequency range of a human voice as indicated by the audio filter 399

FIGS. 4A, 4B, 4C and 4D describe various exemplary embodiments of an audio privacy system in accordance with the present invention. In these illustrations, system details and module interconnections and power supply are not depicted. It is considered that these features are well understood by those of ordinary skill in electronics.

Figure 4A:
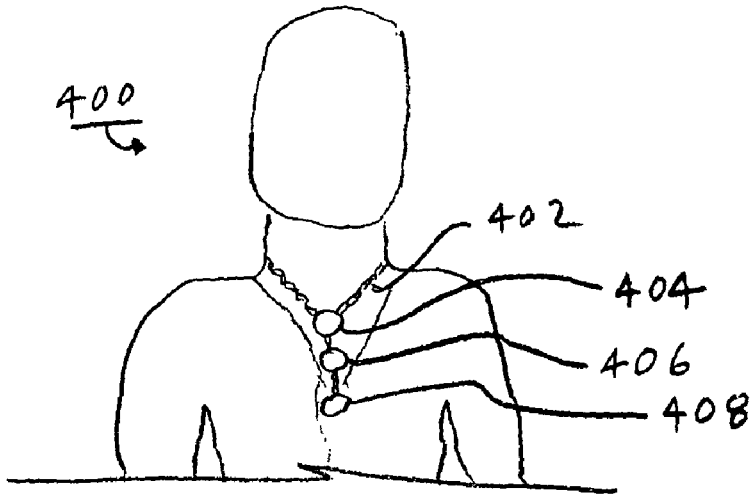
FIG. 4A is an illustration using an item of jewelry to provide an audio privacy system in accordance with an embodiment of the present invention.

An illustration using an item of jewelry to provide an audio privacy system 400 as described herein is provided in FIG. 4A. In an embodiment, a necklace 402 having one or more pendants 404, 406, 408 is envisioned. In such an embodiment, each pendant may comprise one or more the overall audio privacy system. For example, pendant 404 may also function as a signal sampling module, such as a microphone, pendant 406 may function as the signal processing module, and pendant 408 may function as the signal interfering module, such as a speaker. In a preferred embodiment, the pendants 404, 406, 408 are designed to be visually appealing, such as by having a real or artificial gemstone façade. In an embodiment, any form of jewelry may be used, with the various system components incorporated in one or more of the jewelry item's elements. For example, a single larger pendant may be used instead of the three depicted here, with all the system components residing therein. Similarly, other embodiments are envisioned having any number of elements, and any distribution of system components.

Figure 4B:
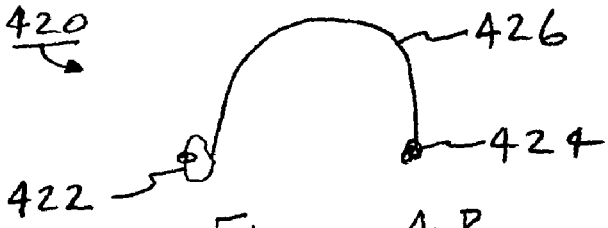
FIG. 4B is an illustration using a headset to provide an audio privacy system in accordance with an embodiment of the present invention.

An illustration using a headset 420 to provide a privacy system is provided in FIG. 4B. In an embodiment, the headset 420 comprises an arm 426 for placement on the user's head, the arm 426 having a gripping node 424 on one side and the audio privacy system 422 on the other side, for advantageous placement near a user's ear. In such an embodiment, the audio privacy system comprises a signal sampling module, such as a microphone, a signal processing module, and a signal interfering module, such as a speaker. In alternative embodiments (not depicted), on or more of the modules may be located at a location other than on the headset 420, or may be located on another part of the headset 420.

Figure 4C:
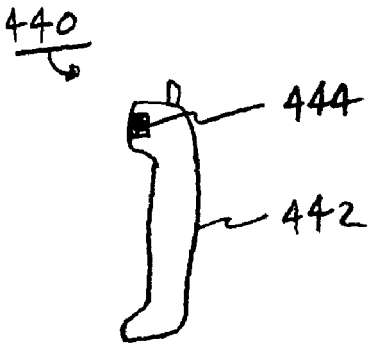
FIG. 4C is an illustration using a telephone receiver with additional internal components to provide an audio privacy system in accordance with an embodiment of the present invention.

An illustration using a telephone receiver 440 with additional internal components to provide an audio privacy system in accordance with an embodiment of the invention is presented in FIG. 4C. In an embodiment, a telephone receiver 440, such as one having a handheld portion 442, includes internally an audio privacy system 444 having a signal sampling module, such as a microphone, a signal processing module, and a signal interfering module, such as a speaker. In alternative embodiments, the modules may be located internally in any portion of the telephone receiver 440.

Figure 4D:
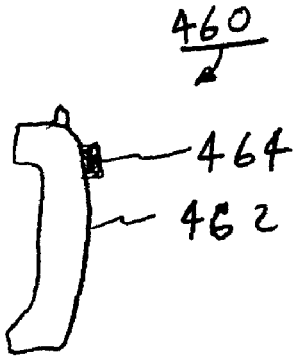
FIG. 4D is an illustration using a telephone receiver with additional external components to provide an audio privacy system in accordance with an embodiment of the present invention.

An illustration using a telephone receiver 460 with additional external components to provide a system in accordance with an embodiment of the invention is presented in FIG. 4D. In an embodiment a telephone receiver 440, such as one having a handheld portion 462, includes internally an audio privacy system 464 having a signal sampling module, such as a microphone, a signal processing module, and a signal interfering module, such as a speaker. In alternative embodiments, the modules may be located externally in any portion of the telephone receiver 460. In a further embodiment, some modules may be located internally, while others are located externally.

In an embodiment of the invention, a user uses a telephone for a phone call with another user or users, the system thereby providing a quiet space for a telephone user. The telephone uses the system for providing a quiet space. The telephone includes a microphone and a speaker. The user speaks into the microphone. The microphone includes a signal sampling Module. The speaker includes a signal interfering module. The microphone samples the sound signal from the user and the interfering sound signal from the speaker. In one embodiment, the telephone includes a signal processing module. In another embodiment, the telephone connects to a signal processing module. The signal processing module preferably generates an interfering audio object based on the sampled audio object. The user then emits a sound signal, and the speaker emits an interfering sound signal. The interfering sound signal is the inverted version of a sound that equals or approximates the sound signal. The combined sound signal of the interfering sound signal and the sound signal do not allow the sound signal to be heard intelligibly, creating a quite space for the user.

In another embodiment of the invention, a personal conversational device includes the system for providing a quiet space. A person wears a personal conversation device close to his ears. In one embodiment, the person wears the device around his neck like a necklace. In another embodiment, the person wears the device as a brooch, or another item of jewelry. In one embodiment, the person wears the device as an attachment to his eye glasses. In another embodiment, the person wears the device as a hairpin. In one embodiment, the person wears the device as part of his hat.

In such an embodiment, the device samples the sound signals from the surroundings, emits an interfering sound signal that is the inverted version of a sound that equals or approximates the surrounding sound signals. The interfering sound signal cancels or weakens the surrounding sound signals to create a quite space around the person's ears. In one embodiment, the device emits an interfering sound signal that is an inverted version of a sound that equals or approximates the non-human voice portion of the surrounding sound signals. The interfering sound signal cancels or weakens the non-human voice portion of the surrounding of sound signals. Two people each wearing a personal conversational device can converse comfortably in a noisy environment, such as inside a shopping mall, along a busy street, on board of a commuter train, inside a night club, or in a rock concert.

In another embodiment of the invention, a virtual sound wall device includes the system for providing a quiet space. A virtual sound wall device is preferably installed along a boundary separating a protected area from a noisy environment. In one embodiment, the noisy environment is a highway, a street, an exhibition floor, a stadium or an area where an event takes place. In another embodiment, the protected area is a house, an exhibition booth, a food stand, a ticket box office, or an outdoor restaurant.

In an embodiment, a boundary may have no physical delimiter to indicate where the boundary is located. For example, a boundary may exist essentially in the open between an area a user wants to protect from noise, and an area that is noisy, such as an airport, without any physical manifestation or wall indicating where the boundary is located. In such an embodiment, the boundary is located at the loci where the protected space meets the noisy area. Of course, a physical boundary may be present as well. For example, a boundary may comprise an actual physical boundary such as fixed or movable objects to which a suitable device may be attached. Examples of physical boundaries include but are not limited to walls, half walls, knee walls and the like, separating cubicles in an office, pylons, bollards, and the like.

In operation, an exemplary sound wall device includes a signal sampling module positioned to face the noisy environment, and the signal interfering module is positioned to face the protected area. The signal sampling module samples sound signals from the noisy environment and the sound signal emitted by the people inside the protected area. In one embodiment, the sound signal emitted by the people diminishes upon reaching the signal sampling module due to the direction of the signal sampling module. In an embodiment, the combined sound signal approximates the sound signals from the noisy environment due to the diminished strength of the sound signal emitted by the people. The interfering sound signal emitted by signal interfering module is then the inverted version of a sound that equals or approximates sound signals from the noisy environment. The interfering sound signal thereby cancels or weakens the sound signal from the noisy environment.

In one embodiment, multiple virtual sound wall devices installed along the boundary create a plurality of quite spaces in the protected area. In an embodiment, the quite spaces are contiguous, the distance between adjacent virtual sound wall devices depending on the strength of the sound signals from the noisy environment and the topology of the boundary. In various embodiments, the distance may be 3 feet, 10 feet, 25 feet, 12.5 feet, or any other suitable distance.

In an embodiment, the signal sampling module and signal interfering module are separated by a distance. For example, the signal sampling device may be attached to a tree along a busy street, and the signal interfering device may be attached to a window of a house. In another embodiment, the signal sampling module may be located at a highway wall, with the signal interfering module located at the backyard fence of a house. In another embodiment, the signal interfering module attenuates the strength of the interfering sound signal to match that of the sound signals from the noisy environment. In another embodiment, the level of attenuation is configured in the virtual sound wall device based on the estimated diminishment of the sound signals from the noisy environment upon reaching the signal interfering module.

In an embodiment, the signal processing module creates a processed audio object based on a plurality of audio filters. In one embodiment, the plurality of audio filters has an order. In another embodiment, each of the audio filters includes a sequence number, and the order of the plurality of audio filters is based on the sequence number. In another embodiment, each of the audio filters includes a time marker. In one such embodiment, the time marker includes the time of day when the signal processing module stores the audio filter. In another embodiment, the time marker includes a relative time, and the order of the plurality of audio filters is based on the time marker.

In an embodiment, the signal processing module selects an audio filter based on the order for the generation of a processed audio object. In one embodiment, the signal processing module selects multiple audio filters based on the order for the generation of a processed audio object.

In one embodiment, the signal processing module computes an average value of the selected multiple audio filters, and generates a processed audio object based on the average value. In another embodiment, the signal processing module computes a weighed average value of the selected multiple audio filters, and generates a processed audio object based on the weighted average value.

In an embodiment, the signal processing module adjusts a processed audio object such that the amplitude of the sound represented by the processed audio object matches the amplitude of the sound represented by the sampled audio object.

In another embodiment, the plurality of audio filters represents a white noise sound.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An audio privacy system comprising:

a signal sampling module which operates to receive and sample a combined sound signal comprising the voice of a user of the system over a series of sampling time intervals and which operates to generate a sequence of sampled audio objects, wherein each sampled audio object represents the combined sound signal for sampling time interval for the sampled audio object;

a signal interfering module for emitting an interfering sound signal positioned in a direction to emit the interfering sound signal destructively with the voice of the user; and a signal processing module comprising an audio filter, operatively connected to receive the sampled audio objects from the signal sampling module and to generate and transmit a sequence of interfering audio objects based on a sequence of sampled audio objects it receives to the signal interfering module, wherein for each sampled audio object, the signal processing module computes a recovered audio object which represents an approximation of the combined sound signal by subtracting the sound represented by the audio filter from the sound represented by the sampled audio object, wherein the interfering audio objects comprise an inversion of the recovered audio objects and the audio filter is an audio object approximating the interfering sound signal emitted by the signal interfering module such that the interfering sound signal destructively interferes with the voice of the user.

2. The audio privacy system according to claim 1, the signal sampling module, signal interfering module and signal processing module together comprising an item wearable by a user.

3. The audio privacy system according to claim 1, the signal sampling module, signal interfering module and signal processing module together comprising an item selected from the group consisting of a headset, jewelry and eyeglasses.

4. The audio privacy system according to claim 1, wherein the signal sampling module comprises a microphone, the signal interfering module comprises a speaker and the signal sampling module and signal interfering module are mounted on or in a communication device.

5. The audio privacy system according to claim 1, the signal processing module comprising an application specific integrated circuit.

6. The audio privacy system according to claim 1, in which the signal processing module comprises a microprocessor and associated memory, the microprocessor being configured to perform the signal generating function of the signal processing module.

7. The audio privacy system according to claim 1, the signal sampling module configured to filter out sounds over a predetermined decibel level.

8. The audio privacy system according to claim 1, the predetermined decibel level being 100 decibels.

9. The audio privacy system according to claim 1, wherein a sound represented by the audio filter is filtered from the sampled audio object before inverting the sampled audio object to generate the interfering audio object.

10. The audio privacy system according to claim 1 wherein the signal processing module is operable to replace the audio filter with the interfering audio object so that the interfering audio object is a new audio filter and is operable to employ the new audio filter to process a next sampled audio object.

11. The audio privacy system according to claim 1, wherein the audio filter comprises an audio normalization factor, and the subtract function comprises adjusting the amplitude of the recovered audio objects to an amplitude level indicated by the audio normalization factor.

12. A method of providing a quiet area for a user participating in a telephone conversation using an audio privacy system, comprising:

positioning a signal sampling device in an area proximate a source from which the user's voice emanates into a telephone mouthpiece adequate to receive the voice of the user;

receiving, at the signal sampling device and sample a combined sound signal comprising the voice of the user over a series of sampling intervals;

generating a sequence of sampled audio objects, based on the voice of the user, wherein each sampled audio object represents the combined sound signal for a sampling time interval for the sampled audio object;

providing a signal processing module, operatively connected to receive the sampled audio objects from the signal sampling module;

generating and transmitting a sequence of interfering audio objects to a signal interfering module, the interfering audio objects generated based on a sequence of sampled audio objects wherein the audio objects comprise the inverted form of the sampled audio objects, filtering, using an audio filter which is an audio object approximating an interfering sound signal emitted by the signal interfering module computing for each sampled audio object a recovered audio object which represents an approximation of the combined sound signal by subtracting the audio object represented by the audio filter from the sound represented by the sampled audio object; and positioning the signal interfering module for emitting an interfering sound signal in a direction to emit an interfering sound signal destructively with the voice of the user.

13. The method according to claim 12, further comprising replacing, in the signal processing module, the audio filter with the interfering audio object so that the interfering audio object is a new audio filter and using the new audio filter to process a next sampled audio object.

14. The method according to claim 13, the filtering being filtering out of sound in the frequency range of 120 Hz to 3800 Hz.

15. The method according to claim 13, the filtering being filtering out of sound in the frequency range of human speech.

16. The method according to claim 12 comprising providing the audio filter with an audio normalization factor, and the subtract function comprises adjusting the amplitude of the recovered audio objects to an amplitude level indicated by the audio normalization factor.

* * * * *